US007105993B2

(12) United States Patent
Jeon et al.

(10) Patent No.: US 7,105,993 B2
(45) Date of Patent: Sep. 12, 2006

(54) SHADOW MASK FOR CATHODE RAY TUBE HAVING AN APERTURE AREA IN WHICH A CURVATURE OF RADII IN THE HORIZONTAL AND VERTICAL DIRECTIONS SATISFY A PARTICULAR CONDITION

(75) Inventors: Sang-Ho Jeon, Seongnam (KR); Do-Hun Pyun, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 328 days.

(21) Appl. No.: 10/400,631

(22) Filed: Mar. 28, 2003

(65) Prior Publication Data

US 2003/0222562 A1 Dec. 4, 2003

(30) Foreign Application Priority Data

May 28, 2002 (KR) ..... 2002-0029670

(51) Int. Cl.
*H01J 29/80* (2006.01)

(52) U.S. Cl. ..... 313/402; 313/407; 313/477 R

(58) Field of Classification Search ..... 313/402, 313/407–409, 413, 415, 421–422, 461, 477 R
See application file for complete search history.

(56) References Cited

U.S. PATENT DOCUMENTS

| | | | | |
|---|---|---|---|---|
| 4,677,339 | A * | 6/1987 | Inoue et al. | 313/402 |
| 5,506,470 | A * | 4/1996 | Inoue et al. | 313/477 R |
| 6,407,489 | B1 * | 6/2002 | Lee | 313/402 |
| 6,642,642 | B1 * | 11/2003 | Watanabe et al. | 313/402 |
| 6,650,034 | B1 * | 11/2003 | Watanabe et al. | 313/402 |
| 6,650,035 | B1 * | 11/2003 | Matsudate | 313/402 |
| 6,713,951 | B1 * | 3/2004 | Okamoto et al. | 313/402 |
| 2003/0122474 | A1 * | 7/2003 | Lee | 313/477 R |

* cited by examiner

*Primary Examiner*—Karabi Guharay
*Assistant Examiner*—Kevin Quarterman
(74) *Attorney, Agent, or Firm*—Stein, McEwen & Bui, LLP

(57) ABSTRACT

A shadow mask for a cathode ray tube includes an aperture area having a plurality of apertures passing electron beams, a non-aperture area extending a predetermined distance from a circumference of the aperture area and a skirt extending a predetermined distance from an outside circumference of the non-aperture area and bent at a predetermined angle to the non-aperture area, wherein the aperture area has predetermined curvature radii, and wherein if a curvature radius in a horizontal direction of the aperture area is $R_{hs}$, and a curvature radius in a vertical direction is $R_{vs}$, the following condition is satisfied, $$0.6<R_{vs}/R_{hs}<0.8.$$

13 Claims, 2 Drawing Sheets

SHADOW MASK FOR CATHODE RAY TUBE HAVING AN APERTURE AREA IN WHICH A CURVATURE OF RADII IN THE HORIZONTAL AND VERTICAL DIRECTIONS SATISFY A PARTICULAR CONDITION

CROSS-REFERENCE TO RELATED APPLICATIONS

This application claims the benefit of Korean Application No. 2002-29670 filed May 28, 2002, in the Korean Intellectual Property Office, the disclosure of which is incorporated herein by reference.

BACKGROUND OF THE INVENTION

1. Field of the Invention

The present invention relates to a shadow mask for a cathode ray tube. More particularly, the present invention relates to a shadow mask that is suitable for use in a cathode ray tube having a large and flat panel, and to a cathode ray tube using the shadow mask.

2. Description of the Related Art

When a cathode ray tube (CRT) is applied as the main element in a color television, a shadow mask used in the CRT performs a color selection function by directing electron beams emitted from an electron gun such that the electron beams correctly land on a phosphor screen. The shape of such a shadow mask is determined by the size and shape of the CRT panel, which is a front glass portion of the CRT. The shadow mask typically has a curvature radius of R=2,000 mm in a diagonal direction of the shadow mask (assuming the shadow mask is substantially rectangular). However, with consumer preference for larger and flatter screens in recent times, it is necessary to increase the size and flatten the shadow mask when used in such a CRT.

In practice, when a shadow mask is applied to a large-sized CRT using a panel with a flat external surface and a curved inner surface, a shadow mask is used that matches the size of the panel but is curved identically to conventional shadow masks. If the shadow mask is both enlarged and its curvature radius increased, the mask becomes structurally weak. This causes many problems. For example, if the curvature radius of the shadow mask is 1.6 R or greater, the shadow mask may be easily deformed by an external shock of a predetermined force or greater. Such deformation of the shadow mask significantly reduces the quality of the CRT.

Further, the shadow mask becomes vulnerable to howling, a phenomenon caused by transfer of vibration, if increased in size and made flatter. For example, if the CRT having a shadow mask is used in a large color television, the shadow mask vibrates as a result of sound generated by the speakers. With the increase in the size of the shadow mask, howling becomes even more of a problem since the shadow mask becomes structurally weak.

To remedy the problem of deformation of the shadow mask as a result of receiving a shock, a thickness of the panel to which the shadow mask is mounted is adjusted. In particular, peripheral portions of the panel are made greater in thickness than a center portion of the same (approximately two times thicker or more), and the shadow mask is formed having a corresponding radius such that damage caused by external shock may be reduced.

However, by this formation of the panel in which the peripheral portions are made thicker than the center portion thereof, the overall weight of the CRT increases. This makes manufacture more difficult and may inconvenience users when moving the device.

In addition, if an optimum thickness ratio between the center and peripheries of the panel in consideration of the shock characteristics of the shadow mask is not able to be obtained, that is, if the thickness at peripheries is too great compared to the thickness of the center portion of the panel, it becomes necessary to form a coating film, which adjusts transmissivity, on a front surface of the panel in order to prevent a deterioration in contrast characteristics of the CRT caused by the transmissivity of the glass forming the panel. This extra step of forming the coating film complicates the overall manufacturing process, ultimately increasing CRT unit costs.

Therefore, a reduction in the shock characteristics of the shadow mask when making the panel flat and increasing the size of the panel and shadow mask, as well as the complication in the manufacture of the CRT resulting from attempts to improve its brightness characteristics are contrary to efforts at providing a superior CRT.

SUMMARY OF THE INVENTION

An aspect of the present invention is to provide a shadow mask for a cathode ray tube, in which the shadow mask is not susceptible to damage from external shocks, even when applied to a cathode ray tube having a flat and enlarged panel.

In one aspect, a shadow mask for a cathode ray tube includes an aperture area having a plurality of apertures passing electron beams. A non-aperture area extends a predetermined distance from a circumference of the aperture area. A skirt extends a predetermined distance from an outside circumference of the non-aperture area and is bent at a predetermined angle to the non-aperture area. The aperture area has a predetermined curvature radii, wherein if a curvature radius in a horizontal direction of the aperture area is $R_{hs}$, and a curvature radius in a vertical direction is $R_{vs}$, the following condition is satisfied, $$0.6<R_{vs}/R_{hs}<0.8.$$

In another aspect, a cathode ray tube includes a panel having a substantially flat outer surface and a curved inner surface, and having a phosphor screen on the inner surface. A funnel is connected to the panel and including a deflection yoke that is mounted to an outer circumference of the funnel. A neck is connected to the funnel and having an electron gun mounted within the neck. A shadow mask is mounted inwardly from the panel and performing color selection of electron beams emitted from the electron gun. The shadow mask includes an aperture area having a plurality of apertures passing electron beams, a non-aperture area extending a predetermined distance from a circumference of the aperture area, and a skirt extending a predetermined distance from an outside circumference of the non-aperture area and bent at a predetermined angle to the non-aperture area. The aperture area has a predetermined curvature radii, and wherein if a curvature radius in a horizontal direction of the aperture area is $R_{hs}$, and a curvature radius in a vertical direction is $R_{vs}$, the following condition is satisfied, $$0.6<R_{vs}/R_{hs}<0.8.$$

If a thickness of the shadow mask is $t_s$, the following condition is satisfied, $$0.15\text{ mm}<t_s<0.25\text{ mm}.$$

If a center axis passing through a center of the aperture area of the shadow mask is Z, a distance along the center axis Z from an innermost surface of the center of the aperture area to an outermost edge of the aperture area in the diagonal direction is $d_{sd}$, a distance along the center axis Z from the innermost surface of the center of the aperture area to an outermost edge of the aperture area in the horizontal direction is $d_{sh}$, and a distance along the center axis Z from the innermost surface of the center of the aperture area to an outermost edge of the aperture area in the vertical direction is $d_{sv}$, the following condition is satisfied, $$d_{sv}<d_{sh}<d_{sd}.$$

Further, if $R_{hp}$ is a curvature radius of the inner surface of the panel in the horizontal direction and $R_{vp}$ is a curvature radius of the inner surface of the panel in the vertical direction, the following condition is satisfied, $$0.3<R_{vp}/R_{hp}<0.6.$$

A transmissivity of a center area of the panel is preferably 60% or less.

If $t_{pc}$ is a center thickness of an effective area of the panel and $t_{pd}$ is a thickness of the panel at peripheries in the diagonal direction, the following condition is satisfied, $$1.3<t_{pd}/t_{pc}<1.8.$$

If a center axis passing through a center of the panel is Z, a distance along the center axis Z from an innermost surface of a center of the panel to an outermost edge of the panel in the diagonal direction is $d_{pd}$, a distance along the center axis Z from the innermost surface of the center of the panel to an outermost edge of the panel in the horizontal direction is $d_{ph}$, and a distance along the center axis Z from the innermost surface of the center of the panel to an outermost edge of the panel in the vertical direction is $d_{pv}$, the following condition is satisfied, $$d_{ph}<d_{pv}<d_{pd}.$$

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
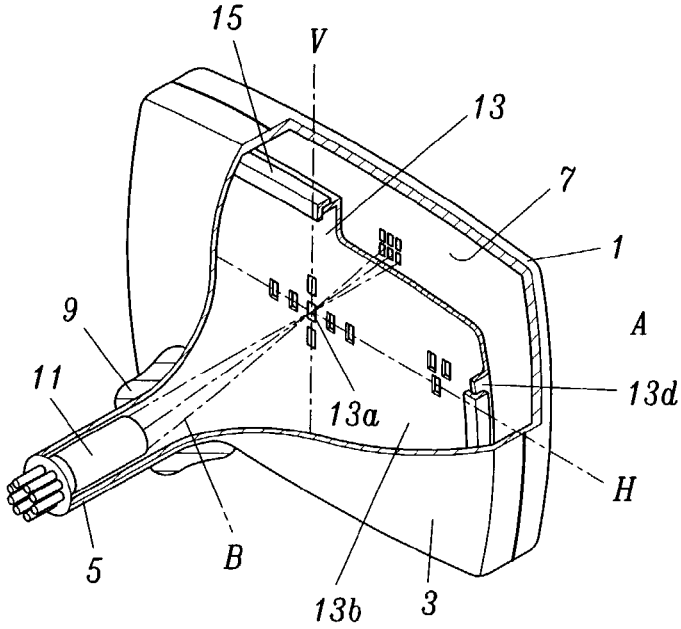
FIG. 1 is cutaway perspective view of a cathode ray tube according to an embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Referring to FIG. 1, an exterior of a cathode ray tube (CRT) is defined by a panel 1, a funnel 3, and a neck 5, which are fused into an integral, tube-like structure.

Figure 2:
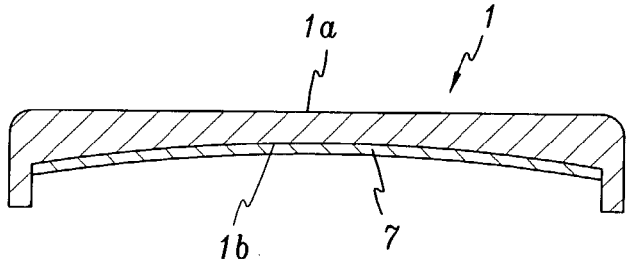
FIG. 2 is a sectional view of a panel of the cathode ray tube of FIG. 1.

The panel 1 is substantially rectangular and a phosphor screen 7 is on an inner surface of the panel 1. The phosphor screen 7 includes a phosphor layer in a dot or striped pattern. With reference also to FIG. 2, an outer surface 1*a* of the panel 1 is substantially flat, while an inner surface 1*b* of the panel 1 has a predetermined curvature radius. When the CRT is applied to a display (e.g., a color television), such a shape of the panel 1 allows for the realization of a picture with an exceptional three-dimensional and flat feel.

The funnel 3 fused to the panel 1 is, as its name suggests, funnel-shaped. A deflection yoke 9 is mounted to a predetermined location of an exterior of the funnel 3. An electron gun 11 is mounted within the neck 5, which is fused to the funnel 3. The electron gun 11 emits three electron beams B and the deflection yoke 9 forms a magnetic field to deflect the electron beams B.

Figure 3:
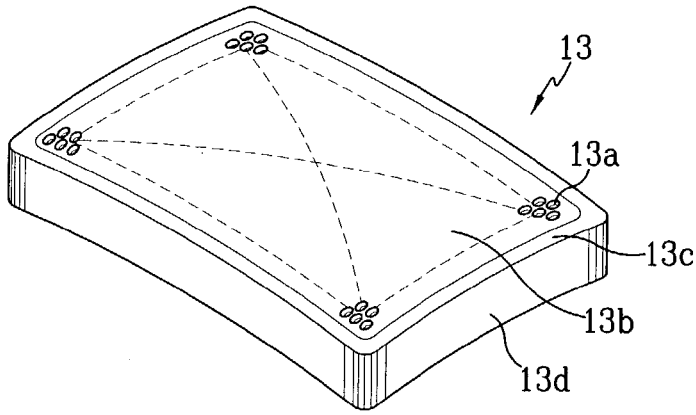
FIG. 3 is a plan view of a shadow mask of the cathode ray tube of FIG. 1.

A shadow mask 13, which acts as a color selection apparatus in the CRT, is mounted inwardly from the panel 1 (a predetermined distance toward the electron gun 11) by being supported by a mask frame 15. The shadow mask 13, with reference also to FIG. 3, includes an aperture area 13*b* having a plurality of apertures 13*a* through which the electron beams B pass, a non-aperture area 13*c* extending a predetermined distance from a circumference of the aperture area 13*b*, and a skirt 13*d* extending a predetermined distance from an outer circumference of the non-aperture area 13*c* in a direction substantially perpendicular to the aperture area 13*b* and the non-aperture area 13*c*. The portion of the shadow mask 13 formed by the aperture area 13*b* and the non-aperture area 13*c* is substantially rectangular. Also, the aperture area 13*b* has a predetermined curvature radius that substantially corresponds to the shape of the inner surface 1*b* of the panel 1.

In the CRT structured as in the above, the three electron beams B (red, green, and blue electron beams) are deflected by the deflection yoke 9 in a horizontal direction (or long axis direction) H and a vertical direction (or short axis direction) V of the panel 1 such that the three electron beams B converge onto a single aperture 13*a* of the shadow mask 13. The electron beams B then pass through the aperture 13*a* to land on a desired phosphor of the phosphor screen 7 to illuminate the same. This process is repeated in a process of scanning the phosphor screen 7 to thereby realize the display of predetermined images.

In the case where the panel 1 is enlarged and its outer surface 1*a* made more flat, a configuration as described below is used to minimize damage from outside shocks and allow for favorable operation.

Figure 4:
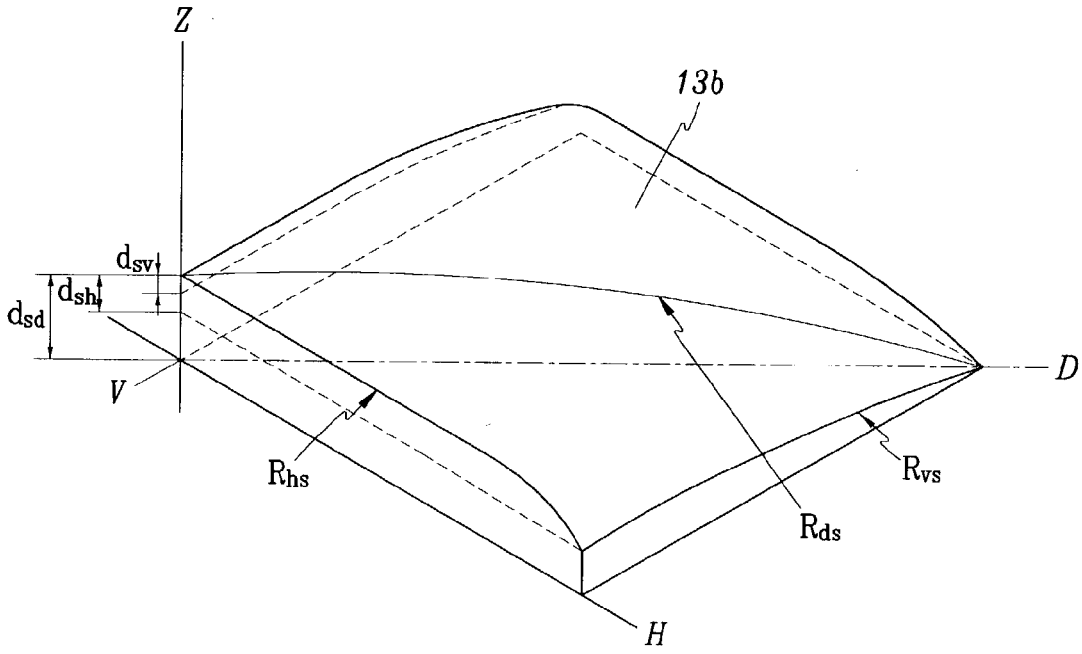
FIG. 4 is a schematic view of a shadow mask of the cathode ray tube of FIG. 1 used to describe the relation of curvature radii in each direction of the shadow mask.

With reference to FIG. 4, the following condition is satisfied with respect to the curvature of the aperture area 13*b* of the shadow mask 13, $$0.6<R_{vs}/R_{hs}<0.8,$$

where $R_{hs}$ is a curvature radius in a horizontal direction of the aperture area 13*b* of the shadow mask 13, and $R_{vs}$ is a curvature radius in a vertical direction of the aperture area 13*b* of the shadow mask 13.

As an example, for the shadow mask 13 used for testing, $R_{hs}$ and $R_{vs}$ were set at 2603 mm and 2084 mm, respectively, and a curvature radius $R_{ds}$ in a diagonal direction of the aperture area 13*b* was set at 2421 mm.

The above condition of the aperture area 13*b* of the shadow mask 13 is that derived after multiple simulations and much experimentation. That is, it was determined through such simulations and experimentation that the shadow mask 13 best withstands outside shocks when meeting the above criterion.

Figure 5:
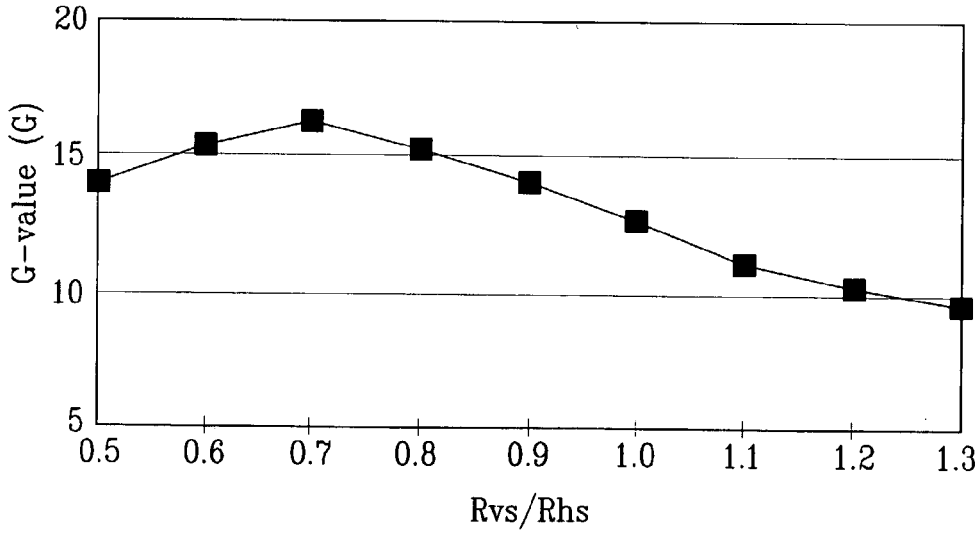
FIG. 5 is a graph showing the relation between a G-value and a ratio of a vertical curvature radius and a horizontal curvature radius of a shadow mask of the cathode ray tube of FIG. 1.

FIG. 5 is a graph showing the relation between a G-value and a ratio of the vertical curvature radius $R_{vs}$, and a horizontal curvature radius $R_{hs}$ of the shadow mask 13.

G-value is the amount of shock applied when the shadow mask 13 is dropped from a predetermined height (typically 30 cm). This value is generally calculated as shown below. In the CRT industry, it is determined that the shadow mask has been safely designed when the G-value is 15 G or somewhat greater.

$$\text{G-value}=1\ \text{G}\times(\text{drop time/braking time})\times n,$$

where n=2.2.

As shown in the graph of FIG. 5, when the ratio $R_{vs}/R_{hs}$ of the vertical curvature radius $R_{vs}$ to the horizontal curvature radius $R_{hs}$ of the shadow mask 13 is maintained at greater than or equal to 0.6 and less than or equal to 0.8, the G-value is greater than or equal to 15 G. This meets the generally accepted standard and indicates that the shadow mask 13 is able to sufficiently withstand external shocks.

A thickness $t_s$ of the shadow mask 13 used during testing was maintained in the range between and including 0.15 mm and 0.25 mm (0.15 mm$<t_s<$0.25 mm). Referring again to FIG. 4, if a center axis passing through a center of the aperture area 13*b* of the shadow mask 13 is Z, a distance along the center axis Z from an innermost surface of the center of the aperture area 13*b* to an outermost edge of the aperture area 13*b* in the diagonal direction D is $d_{sd}$, a distance along the center axis Z from the innermost surface of the center of the aperture area 13*b* to an outermost edge of the aperture area 13*b* in the horizontal direction H is $d_{sh}$, and a distance along the center axis Z from the innermost surface of the center of the aperture area 13*b* to an outermost edge of the aperture area 13*b* in the vertical direction V is $d_{sv}$, the following condition is satisfied, $$d_{sv}<d_{sh}<d_{sd}.$$

The panel 1 may be made of what is referred to as semi-tint glass that has a transmissivity of 60% or less at a center area (based on a thickness of 11.43 mm). A ratio of curvature radii of the inner surface 1*b* of the panel 1 satisfies the following condition, depending on the curvature radius characteristics of the shadow mask 13, $$0.3<R_{vp}/R_{hp}<0.6,$$

where $R_{hp}$ is a curvature radius of the inner surface 1*b* of the panel 1 in the horizontal direction H, and $R_{vp}$ is a curvature radius of the inner surface 1*b* of the panel 1 in the vertical direction V.

As an example, the $R_{hp}$ and $R_{vp}$ of the panel 1 used during testing in the CRT was 5938 mm and 2045 mm, respectively. Also, a curvature radius $R_{dp}$ in the diagonal direction D of the inner surface 1*b* of the panel 1 was 5107 mm.

The curvature radii with respect to the inner surface 1*b* of the panel 1 are limited in this manner in the present invention in consideration of (a) the curvature radii relation that the shadow mask 13 has, (b) a pitch of the apertures 13*a* of the shadow mask, particularly the pitch of the apertures 13*a* in the horizontal direction H, that is, the relation with the horizontal resolution, and (c) a transmissivity at peripheries in all directions.

With respect to the effective surface of the panel 1, if a center axis passing through a center of the panel 1 is Z, a distance along the center axis Z from an innermost surface of a center of the panel 1 to an outermost edge of the panel 1 in the diagonal direction D is $d_{pd}$, a distance along the center axis Z from the innermost surface of the center of the panel 1 to an outermost edge of the panel 1 in the horizontal direction H is $d_{ph}$, and a distance along the center axis Z from the innermost surface of the center of the panel 1 to an outermost edge of the panel 1 in the vertical direction V is $d_{pv}$, the following condition is satisfied, $$d_{ph}<d_{pv}<d_{pd}.$$

In addition to the above condition, the panel 1 may also satisify the following condition, $$1.3<t_{pd}/t_{pc}<1.8,$$

where $t_{pc}$ is a center thickness of the effective area of the panel 1 and $t_{pd}$ is a thickness of the panel at peripheries in the diagonal direction D.

In a CRT that includes the panel 1 satisfying the above conditions and that also includes the above shadow mask 13 mounted to the panel 1 (typically at a predetermined distance from the panel 1), the results of measuring transmissivities at various areas of the panel 1 reveal, as shown in Table 1, that the lowest transmissivity is 58.2% (in the diagonal direction) when a desired G-value of the shadow mask 13 is maintained. This indicates that the CRT of the present invention is able to realize desired contrast characteristics without the use of a separate black coating film as in conventional CRTs.

TABLE 1

| No. | Transmissivity at center area | Transmissivity at horizontal peripheries | Transmissivity at vertical peripheries | Transmissivity at diagonal peripheries | G-value |
|---|---|---|---|---|---|
| 1 | 100% | 75.2% | 71.0% | 58.2% | 15G |
| 2 | 100% | 72.4% | 61.4% | 59.5% | 17G |

As described above, by limiting the interrelation of the curvature radii of the shadow mask of the present invention, an additional structure is not required for the panel and contrast characteristics required for the CRT may be obtained using only the glass of the panel. As a result, the manufacturing process may be simplified such that increased productivity and decreased unit costs are realized.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A shadow mask for a cathode ray tube, comprising:

an aperture area having a plurality of apertures passing electron beams;

a non-aperture area extending a predetermined distance from a circumference of the aperture area; and a skirt extending a predetermined distance from an outside circumference of the non-aperture area and bent at a predetermined angle to the non-aperture area, wherein the aperture area has predetermined curvature radii, and wherein if a curvature radius in a horizontal direction of the aperture area is $R_{hs}$, and a curvature radius in a vertical direction is $R_{vs}$, the following condition is satisfied, $$0.6<R_{vs}/R_{hs}<0.8.$$

2. The shadow mask of claim 1, wherein if a thickness of the shadow mask is $t_s$, the following condition is satisfied, $$0.15\ \text{mm}<t_s<0.25\ \text{mm}.$$

3. The shadow mask of claim 1, wherein if a center axis passing through a center of the aperture area of the shadow mask is Z, a distance along the center axis Z from an innermost surface of the center of the aperture area to an outermost edge of the aperture area in the diagonal direction is $d_{sd}$, a distance along the center axis Z from the innermost surface of the center of the aperture area to an outermost edge of the aperture area in the horizontal direction is $d_{sh}$, and a distance along the center axis Z from the innermost surface of the center of the aperture area to an outermost edge of the aperture area in the vertical direction is $d_{sv}$, the following condition is satisfied, $$d_{sv}<d_{sh}<d_{sd}.$$

4. A display system, comprising:

a panel having a substantially flat outer surface, a curved inner surface, and a phosphor screen on the inner surface;

a shadow mask having a horizontal curvature radius ($R_{hs}$) and a vertical curvature radius ($R_{vs}$) positioned near the panel to direct electron beams to particular positions on the panel, wherein the following condition is satisfied, $$0.6<R_{vs}/R_{hs}<0.8.$$

5. The display system of claim 4, further comprising:

a picture tube that includes the panel.

6. The display system of claim 5, wherein the picture tube comprises:

a cathode ray tube having a funnel connected to the panel and a neck connected to the funnel;

a deflection yoke mounted to an outer circumference of the funnel; and an electron gun mounted within the neck; and wherein the shadow mask is fixedly attached to an inner surface of the funnel.

7. The display system of claim 4, wherein a thickness of the shadow mask ($t_s$) satisfies the following condition, $$0.15\ \text{mm}<t_s<0.25\ \text{mm}.$$

8. The display system of claim 4, wherein a center axis passing through a center of the aperture area of the shadow mask (Z), a distance along the center axis Z from an innermost surface of the center of the aperture area to an outermost edge of the aperture area in the diagonal direction ($d_{sd}$), a distance along the center axis Z from the innermost surface of the center of the aperture area to an outermost edge of the aperture area in the horizontal direction ($d_{sh}$), and a distance along the center axis Z from the innermost surface of the center of the aperture area to an outermost edge of the aperture area in the vertical direction ($d_{sv}$) satisfy the following condition, $$d_{sv}<d_{sh}<d_{sd}.$$

9. The display system of claim 4, wherein a center thickness of an effective area of the panel ($t_{pc}$) and a thickness of the panel at peripheries in the diagonal direction ($t_{pd}$) satisfy the following condition, $$1.3<t_{pd}/t_{pc}<1.8.$$

10. The display system of claim 4, wherein a curvature radius of the inner surface of the panel in the horizontal direction ($R_{hp}$) and a curvature radius of the inner surface of the panel in the vertical direction ($R_{vp}$) satisfy the following condition, $$0.3<R_{vp}/R_{hp}<0.6.$$

11. A shadow mask for a cathode ray tube, comprising:

an aperture area having a plurality of apertures passing electron beams;

a non-aperture area extending a predetermined distance from a circumference of the aperture area; and a skirt extending a predetermined distance from an outside circumference of the non-aperture area and bent at a predetermined angle to the non-aperture area, wherein the aperture area has predetermined curvature radii, and wherein if a curvature radius in a horizontal direction of the aperture area is $R_{hs}$, and a curvature radius in a vertical direction is $R_{vs}$, $R_{vs}/R_{hs}$ is approximately 0.7.

12. The shadow mask according to claim 11, wherein if a thickness of the shadow mask is $t_s$, the following condition is satisfied, $$0.15\ \text{mm}<t_s<0.25\ \text{mm}.$$

13. The shadow mask of claim 11, wherein if a center axis passing through a center of the aperture area of the shadow mask is Z, a distance along the center axis Z from an innermost surface of the center of the aperture area to an outermost edge of the aperture area in the diagonal direction is $d_{sd}$, a distance along the center axis Z from the innermost surface of the center of the aperture area to an outermost edge of the aperture area in the horizontal direction is $d_{sh}$, and a distance along the center axis Z from the innermost surface of the center of the aperture area to an outermost edge of the aperture area in the vertical direction is $d_{sv}$, the following condition is satisfied, $$d_{sv}<d_{sh}<d_{sd}.$$

* * * * *